US005921614A

United States Patent [19]

Biedermann et al.

[11] Patent Number: 5,921,614

[45] Date of Patent: Jul. 13, 1999

[54] FAMILY VAN CAMPER

[76] Inventors: Keith Biedermann; Thuy Biedermann, both of 12231 Arkley Dr., Garden Grove, Calif. 92840

[21] Appl. No.: 08/743,965

[22] Filed: Nov. 5, 1996

[51] Int. Cl.[6] ..... B60P 3/345

[52] U.S. Cl. ..... 296/159; 296/165; 108/44; 5/119

[58] Field of Search ..... 108/44; 296/161, 296/160, 159, 165, 26.02, 26.11, 170, 175, 176; 5/118, 119

[56] References Cited

U.S. PATENT DOCUMENTS

| | | | |
|---|---|---|---|
| 3,727,970 | 4/1973 | Delmage | 296/165 |
| 3,934,924 | 1/1976 | Diliberti | 5/119 X |
| 4,088,363 | 5/1978 | Palmer | 296/161 |
| 4,504,049 | 3/1985 | Straub | 296/165 |
| 4,695,087 | 9/1987 | Hollrock | 296/26.02 X |
| 4,867,502 | 9/1989 | Sylvester et al. | 296/26.11 X |
| 5,419,607 | 5/1995 | Oliveira | 296/161 X |

*Primary Examiner*—D. Glenn Dayoan
*Assistant Examiner*—Jason Morrow

[57] ABSTRACT

A van-tent camping system, designed to enlarge sleeping and storage arrangements, is adapted for use with and to provide a tent-like covered extension to the rear of van-type vehicles and sport utility vehicles with upward opening rear doors. When the present invention is combined with a vehicle, it forms a single dwelling structure that provides capabilities for camping, storage, picnics and other recreational activities. The invention includes a sectional platform with a retractable and extendable frame and a tent-like cover that attaches around the extended frame. The tent-like cover is held up by the vehicle and the upward opening rear door of the vehicle. The tent-like structure uses no stakes or poles. A sectional platform is provided inside the vehicle and is a base for a bed. Underneath the platform is provided storage space. The rear most section of the platform is designed to stay in the vehicle to be used for storage shelving. The tent-like cover fits the contours of the vehicle and attaches to the frame, in its extended position, to create an enclosed extension for additional above ground sleeping arrangements. The invention is attached to the vehicle without making any permanent modifications to the vehicle.

3 Claims, 13 Drawing Sheets

FAMILY VAN CAMPER

BACKGROUND—FIELD OF INVENTION

A van-tent camping system, designed to enlarge sleeping and storage arrangements, that is adapted for use with and to provide a tent-like covered extension to the rear of van-type vehicles and sport utility vehicles with upward opening rear doors. When the invention is combined with said vehicles it forms a single dwelling structure that includes a sectional platform with a means to retract and extend a frame and a tent-like covering attaches around the extended frame and is held up by the vehicle and the upward opening rear door of said vehicle. The tent-like structure uses no stakes or poles like traditional tents.

DESCRIPTION OF PRIOR ART

A review of prior art discloses a number of space-adding devices that are typically complicated, cumbersome, awkward to set up and require cleaning after each use. Many of the devices include components which must be assembled and disassembled requiring many parts causing time delays, loss of components and are impractical for nightly stops. Other devices require staking to the ground, which is useless on hard surfaces, along with poles to maintain the structural integrity of the tent-like structure.

Few address a truly integrated system using both a vehicle and a enclosure extension to create an uncluttered space to bed down a family quickly, efficiently and comfortably, with privacy, while providing an aesthetically pleasing way to store belongings.

All lack the amenities necessary for a family to conveniently replace the need for a hotel with less expensive camping arrangements without compromising comfort.

After doing three patents search we found three patents relevant to our invention:

U.S. Pat. No. 4,867,502 Sylvester Sep. 19, 1989

The Cooper Patent and the Hoff Patent reveal rigid tent structures located at the rear of the van to form a camper or room enclosure. They are unrelated to the vans of today having a upward opening rear door.

The Sylvester patent creates a tent enclosure that is held up by a upward opening rear door. Its setup requires maneuvering the vehicle into position, two people and poles to setup, and the stakes which are useless on hard surfaces. It also has a sewn in floor that will require cleaning after each use and may deteriorate over time. Because it does not truly integrate the use of vehicle and tent, it sacrifices readily available bedding space for storage space and vice versa. It also has no privacy feature for those who choose to sleep inside the vehicle.

The above mentioned items will slow the setup and take down time. The above mentioned devices do not provide a self-contained sleeping system that is fast and easy to set up, and an efficient way to store belongings.

OBJECTS AND ADVANTAGES

The present invention is designed to be an accessory for vans and sport utility vehicles with upward opening rear doors. The present invention allows for a well organized, fully integrated use of space through a novel combination of such a vehicle, and a tent-like enclosure to create a self-contained above the ground sleeping system designed for family travel. When combined with said vehicles, it forms a single dwelling structure that provides enhanced capabilities for camping, storage, picnics, and other recreational activities.

The invention provides a platform for storage and sleeping inside the rear of the vehicle and a tent-like enclosure to the rear of said vehicle which includes room for standing, sitting, storage and off the ground sleeping. The platform is created by connecting two sections of free standing platforms. A platform panel is placed on top for sleeping and the space underneath is used to store belongings and equipment. The platform requires a one time set up as a part of a trip preparations. The platform provides users with a large, organized way to store belongings out of sight with easy access and there is no need for removing belongings before preparing for bed. This feature makes it very convenient for users to set up their sleeping arrangements with less work and clutter. Once the trip or vacation is completed, the user simply separates the platform and maintains the rear most platform section behind the third seat to be used as a shelf and with a fan-fold panel on top it is an aesthetically pleasing way to store items out of sight.

The tent-like cover encloses around a frame that extends out of the rear of the platform and when said frame is not being used as an above ground bed or cot it can be partially retracted into the platform and used as a table for picnics and other outings. The frame is designed so that it's components can be assembled into different configurations for various uses. When the frame is completely retracted into the platform there is still plenty of room for storage with easy access.

The present invention can be set up and taken down with little effort by one person quickly and easily. One simply parks the vehicle on any type of surface, open the rear door, pull out the frame and install the cot on to said frame. Alternatively, a fan-fold panel can be used on the frame to create a base for a bed. Next, fold down the adjustable support legs to the ground, throw the tent-like cover over the upward opening rear door, lay it into place and attach it to the vehicle and the frame by means of elastic straps creating an insect proof enclosure. The tent-like cover will fit the contours of the vehicle. No stakes or poles are needed to support the tent. Without the cot or the fan-fold panel in place, the set up provides a sufficiently large enclosed room for sitting or standing and can also be used as a dressing room at the beach or park or as a playroom for the children. The frame can be partially extended and the folded fan-fold panel is placed on it to create a table for dining, buffets or food preparation.

The present invention requires no stakes to the ground, therefore it can be used on any type of surface and may potentially be used by electric, telephone and sewer companies while working in the field on buried cables, phone lines or sewer lines. The employee places the enclosure structure of the present invention over the area to be worked on for protection during inclement wheather and tools of the trade can be concealed out of sight inside the platform.

The tent-like cover is put on from the top down not the bottom up and is not dependent on poles and staking to the ground for the integrity of the structure and has no bottom that can deteriorate and necessitate cleaning after each use. These characteristics make the tent-like cover light and compact for traveling. The tent-like cover fits the contours of the vehicle and covers the rear three windows providing privacy for those sleeping in the van and added stability in case of wind. The tent-like cover also works well as a privacy cover for those who choose to sleep on the platform, in the vehicle, with the rear door of said vehicle closed.

The present invention requires little time and effort to set up and take down and has few loose components that can be lost. The user can stop at well located, less expensive camping facilities instead of more expensive hotels or motels and be in bed within minutes without compromising comfort and the ease of setup will not inhibit the user from stoping at night. The ease of set up and take down enables the user to continue with the normal use of the vehicle for a spur of the moment trip to the store, a hiking trip or a sight seeing excursion. The platform storage area is large enough so your equipment is stored with you wherever you choose to go.

The present invention accomplishes the foregoing without doing any damage to, and/or making any holes to which the enclosure structure is attached, and/or without making any attachments of any mechanical adjuncts (such as screws or nuts and bolts, or clamps) to assist in joining said enclosed structure to the vehicle.

Although the present invention is described with respect to a van, it should be appreciated that the invention is applicable to many makes and models of vehicles with upward opening rear doors. The actual dimensions for the enclosure structure will vary according to the dimensions of the vehicle to which it is to be utilized and also to the size of the rear doors of such vehicles.

Further objects and advantages of our invention will become apparent from a consideration of drawings and ensuing description.

BRIEF DESCRIPTION OF THE DRAWINGS

FIG. 6 shows an exploded view of the removable piece of the platform rear cross member and the "U" shaped cradle mounts it rests on.

REFERENCE NUMERALS IN DRAWINGS

Figure 1:
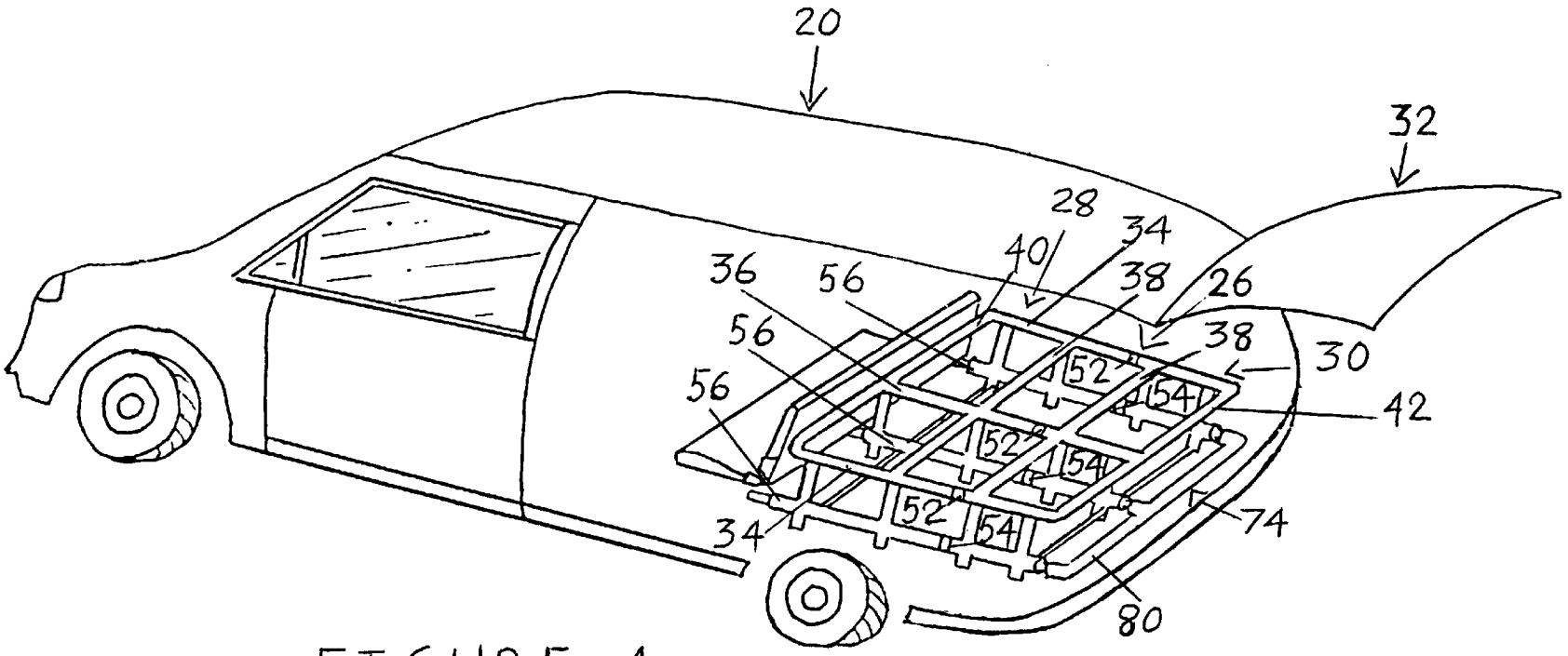
FIG. 1 is a broad perspective view of the type of van being reffered to here in together with a upward opening rear door, rear most seat taken out, and a cross sectional view of the platform and the frame retracted into the platform with the back rest of the middle seat in the up position.

| | |
|---|---|
| 20 | van |
| 26 | platform |
| 28 | forward platform section |
| 30 | rear platform section |
| 32 | upward opening rear door |
| 34 | platform side members |
| 34a | forward platform section side member portions |
| 34b | rear platform section side member portions |
| 36 | platform center member |
| 36a | forward platform section center member portion |
| 36b | rear platform section center member portion |
| 38 | platform middle cross members |
| 40 | platform forward cross member |
| 42 | platform rear cross member |
| 44 | platform forward most side legs |
| 46 | platform forward most center leg |
| 48 | platform middle six legs |
| 50 | platform rearmost three legs |
| 52 | platform member connectors |
| 54 | guide tube connectors |
| 56 | guide tubes |
| 56a | forward platform section guide tube portions |
| 56b | rear platform section guide tube portions |
| 58 | platform panel |
| 59 | platform panel hinges |
| 60 | platform panel forward piece |
| 62 | platform panel center piece |
| 64 | platform panel rear piece |
| 66 | platform rear bottom cross member |
| 68 | platform forward bottom cross member |
| 70 | platform rear cross member removable piece |
| 72 | "U" shaped cradle mounts |
| 74 | frame |
| 76 | frame side members |
| 78 | frame center member |
| 80 | handle bar |
| 82 | guide tube apertures |
| 84 | frame support legs attached to handle bar |
| 86 | frame support leg attached to center member |
| 88 | sissor struts |
| 90 | frame member flexible projections |
| 91 | frame member adapters |
| 92 | handle bar apertures |
| 93 | handle bar flanges |
| 94 | cot |
| 96 | cot tunnel-like openings |
| 98 | cot front flaps |
| 100 | cot rear flap |
| 102 | fan-fold panel |
| 104 | fan-fold panel hinges |
| 106 | fan-fold panel forward piece |
| 108 | fan-fold panel center piece |
| 110 | fan-fold panel rear piece |
| 112 | fan-fold panel flaps |
| 114 | tent-like cover |
| 116 | tent-like cover side portions |
| 118 | tent-like cover end portion |
| 120 | tent-like cover top potion |
| 122 | tent-like cover top portion eyelets |
| 124 | elastic cords |
| 126 | elastic rings |
| 128 | elastic straps |
| 130 | skylight |
| 132 | ties |
| 134 | elastic ties |
| 136 | zipper |
| 138 | tent-like cover rear opening |
| 140 | turn back flap |

-continued

| | |
|---|---|
| 142 | mesh |
| 144 | tent-like cover back opening zipper |
| 146 | tent-like cover side portion openings |
| 148 | tent-like cover side portion opening flaps |
| 150 | handle bar male piece |
| 152 | handle bar female piece |
| 154 | nut |
| 156 | flat head bolt |
| 158 | short tent-like cover |
| 160 | flexible rubber-like strip |
| 162 | short tent-like cover cords |
| 164 | handle bar female piece aperture |
| 166 | handle bar male piece aperture |
| 168 | leg tubes of the adjustable support legs |
| 170 | leg member of the adjustable support legs |
| 172 | apertures along leg tubes |
| 174 | handle bar male piece dowel |
| 176 | handle bar female piece orifice |
| 178 | handle bar couplings |
| 180 | coupling release sleeves |
| 182 | coupling shanks |

DETAILED DESCRIPTION OF DRAWINGS

The Figures illustrate a van-tent camping system comprising of a van 20 with a upward opening rear door 32, a tent-like cover 114, a platform 26 and a pull out frame 74.

FIG. 1 is a cross section view of a van 20 with the middle seat backrest in the up position and the platform 26 inside the rear of the van 20 with the frame 74 fully retracted into the platform 26. The van 20 has an essential feature in the present invention, a upward opening rear door 32, over and above which the tent-like cover is designed to be draped over. The upward opening rear door 32 of the van 20 of the present invention typically has hydraulic arms (not shown) or mechanical arms ( not shown) that are used to keep the rear door in the upward open position.

Figure 2:
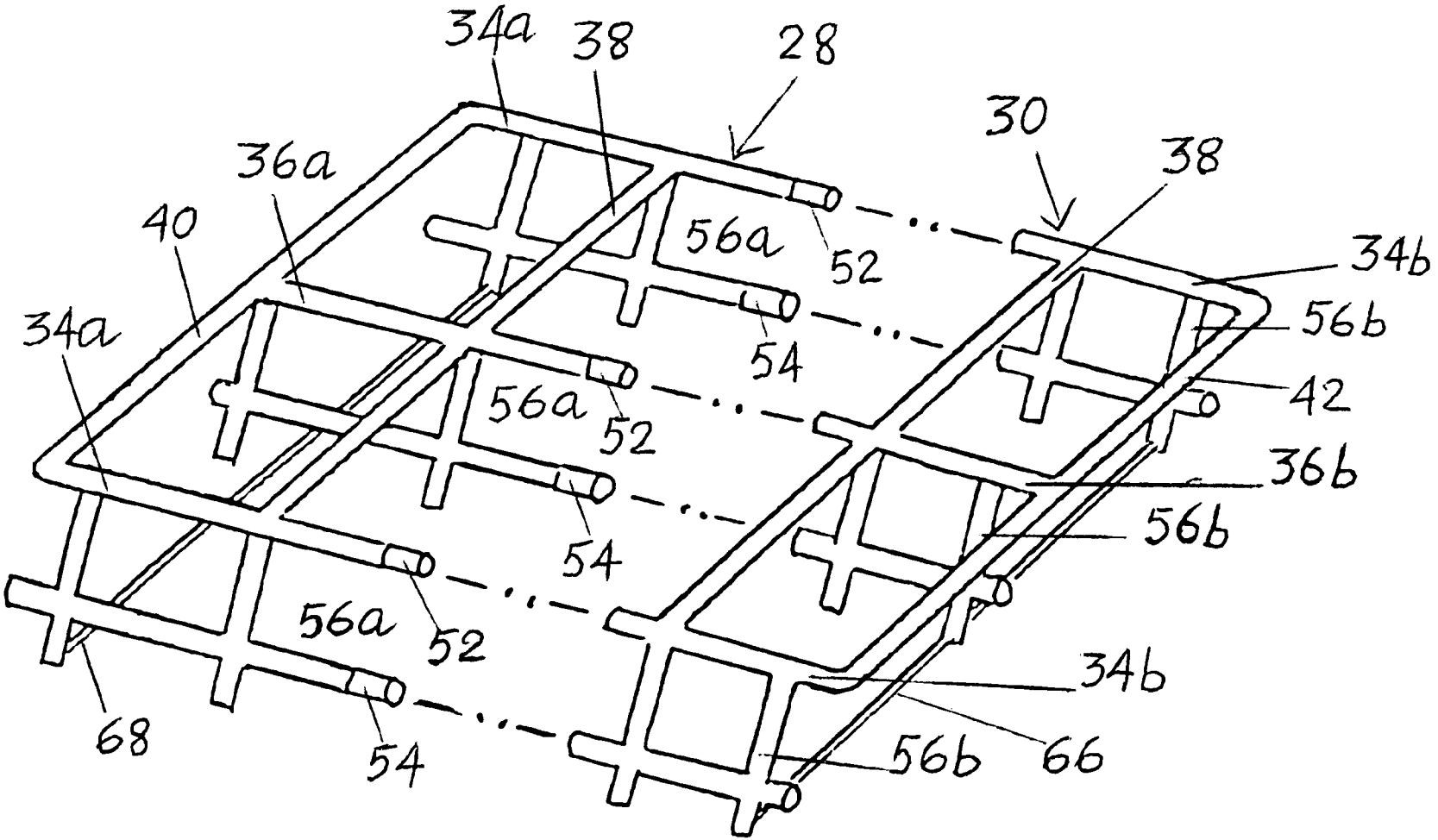
FIG. 2 is a top and side view of the rear and forward sections of the platform separated at the connectors.

Referring to FIG. 2, the platform has a design feature that allows the user to separate said platform into two sections. When not traveling the platform can be separated into a forward section 28 and a rear section 30. The rear platform section 30 is designed to stay in the back of the rear most seat for daily storage use purposes and the forward platform section 28 can be disassembled and stored elsewhere. The rear platform section 30 makes for a nice shelf accessory and with the fan-fold panel placed on top it conceals belongings underneath.

Referring to FIG. 1, the platform 26 separates at the connectors 52 and 54. The platform member connectors 52 are located on the platform side members 34 and the platform center member 36 and are off center to the rear between the platform middle cross members 38. The guide tube connectors 54 are located on the guide tubes 56 directly below the platform member connectors 52. In FIG. 2 all the connectors 52 and 54 are located such that when the platform is separated the rear platform section side member portions 34*b*, center member portion 36*b* and guide tube portions 56*b* are of equal length and likewise for the forward platform section side member portions 34*a*, center member portion 36*a* and guide tube portions 56*a*. Both sections will have six legs and can stand on their own.

The forward platform section 28 will be substantially larger than the rear platform section 30 mainly because the distance between the rear most seat and the rear door of the vehicle in use limits the dimensions of the rear section 30 and therefore will determine the dimensions of the rear platform section 30. Adjustments made to the dimensions of the platform, to accomodate various vehicle sizes, will primarily be made to the rear platform section 30.

Prior to traveling, the present invention requires a one time set up for the entire trip by removing the van's third seat which is the rear most seat and replacing it with the forward platform section 28. The forward platform section 28 is then joined with the rear platform section 30 by means of the connectors 52 and 54 having tube-like openings that are larger than the openings of the two section side member portions 34*a* and 34*b*, the center member portions 36*a* and 36*b* and the guide tube portions 56*a* and 56*b*. Once joined said member portions and said guide tube portions become substantially lengthened and are subsequently referred to as the platform side members 34 and the platform center member 36 and the guide tubes 56 as is shown in FIG. 1.

The platform 26 extends above the floor of the van 20 and is dimensioned such that the platform side members 34 fit snug and contiguous along the interior sides of the van 20 and are parallel to said van floor and substantially perpendicular to the upward opening rear door 32 when closed. The platform side members 34 and the platform center member 36 are of equal length. This length will vary depending on the length of the vehicle in use.

The platform forward cross member 40 abuts up to the backrest of the middle seat, when in the up position, and runs contiguous along the width and more of the backrest and connects to the forward end of the two platform side members 34 and the platform center member 36 at right angles. The rear cross member 42 will extend substantially parallel to the upward opening rear door 32 and the floor of the van 20 and connects to the rearward end of the two platform side members 34 and the platform center member 36 at right angles. The platform forward cross member 40, the platform rear cross member 42 and the two platform middle cross members 38 are parallel to each other and perpendicular to the platform side members 34 and the platform center member 36 and are equal in length and said length is determined by the width of the interior of the vehicle in use. The platform components are constructed of any suitable materials that are generally light in weight, rigid, strong and sturdy.

Figure 3:
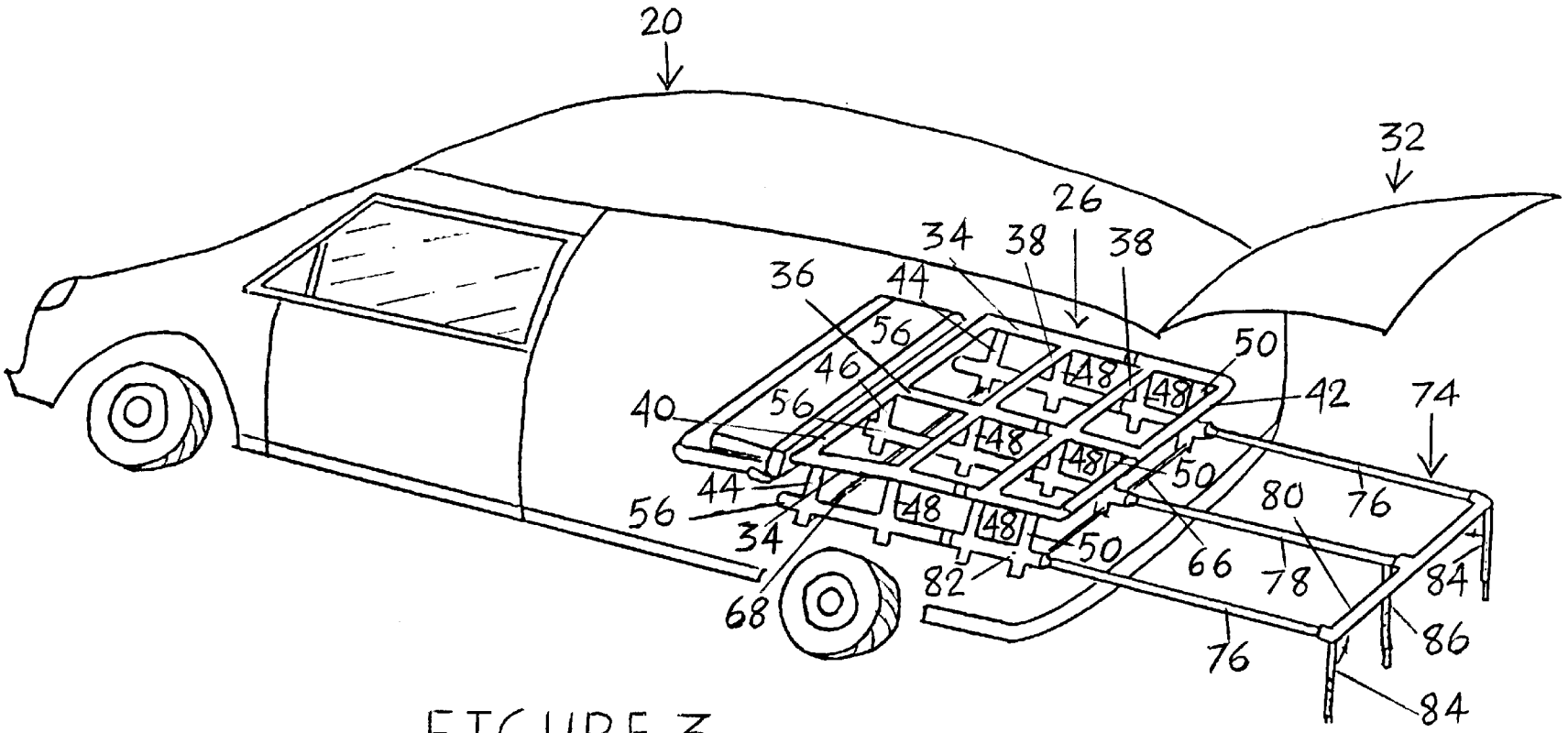
FIG. 3 encompasses all that is in FIG. 1 except the backrest of the middle seat is in the reclined position and the frame is extended out of the rear of the platform, adjacent to the rear of the vehicle, with the adjustable support legs extending vertically to the ground.

FIG. 3 is a cross section view of the van 20 with the middle seat back rest in the reclined position and the platform 26 inside the rear of the van 20 with the frame 74 fully extended out of the rear of the platform 26 adjacent to the rear of the van 20. The top of the platform 26 extends above and is horizontal to and equidistant to the floor of the van 20 and this distance will be determined by the height of the middle seat back rest in its reclined position. Hence, the middle seat back rest in its reclined position will become an extension to the top of the platform 26. The platform 26 and the backrest of the reclined middle seat are on a level plain horizontal to the floor of the van 20 and when used in conjunction with each other, they create a substantially large base for a bed, inside the van 20, that is well suited for adult use.

Figure 4:
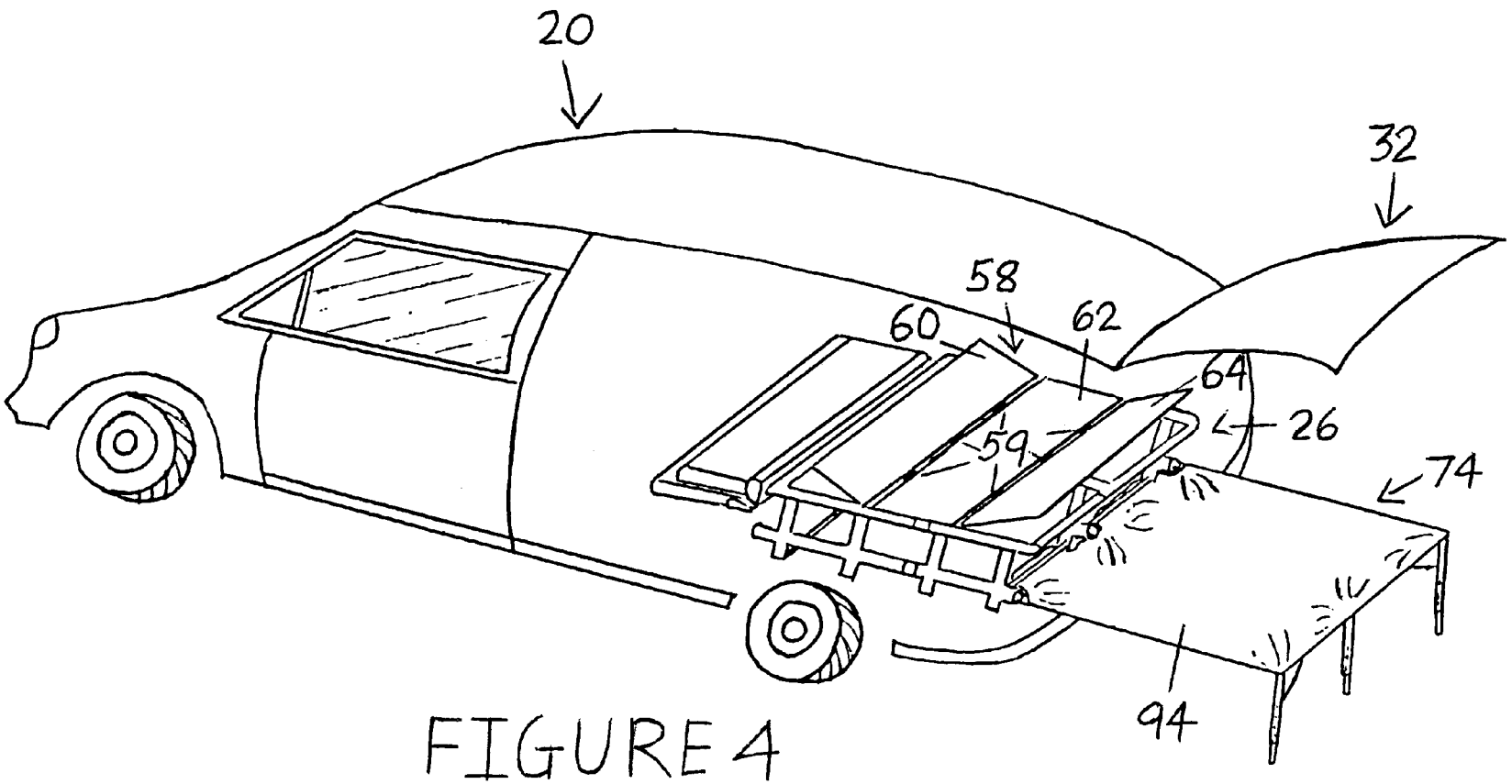
FIG. 4 encompasses all that is in FIG. 3 and includes the panel on top of the platform and the cot is in place on the frame.

FIG. 4 is the same as FIG. 3 with the addition of the platform panel 58 on the platform 26 and the cot 94 in place on the frame 74. The platform panel 58 that lays on top of the platform 26 is horizontal to the floor the van 20 and can be made of any suitable sheet of rigid lightweight material that is strong and sturdy. The platform panel 58 is used to cover the complete expanse of the top of the platform 26 for a bed base and to keep items stored underneath from view. The panel consists of three equal pieces, a forward piece 60, a center piece 62, and a rear piece 64 connected by hinges 59 so that the forward piece 60 and the rear piece 64 can be lifted and items in storage may be accessed from the forward top and the rear top of the platform 26. The center piece 62 remains stationary and connects to the forward piece 60 by hinges 59 on the forward side and the rear piece 64 by hinges 59 on the rear side of itself.

Referring to FIG. 3, the platform 26 is supported by a plurality of legs 44, 46, 48 and 50 that are perpendicular to the platform side members 34, the platform center member 36 and the guide tubes 56 and extend vertically from said members and said guide tubes to the floor of the van 20. The forward most three platform legs 44 and 46 are perpendicular to the two platform side members 34, the platform center member 36 and extend vertically to the floor of the van 20 from said members. The two forward most side legs 44 that are connected to the two platform side members 34, are connected at indented points rear of the junctions of the platform forward cross member 40 and platform side members 34. This indentation creates a large enough opening for the user to access belongings in and out of the rear of the vehicle seat without having to go through the top of the platform 26. The platform forward most center leg 46 is not indented and is connected at the junction of the platform center member 36 and the platform forward cross member 40 and extends vertically to the floor of the van 20. The platform middle six legs 48 extend from the junctions of the platform center member 36 and the platform side members 34 and the two platform middle cross members 38 vertically to the floor of the van 20. The platform rear most three legs 50 are connected to the two platform side members 34 and the platform center member 36 at indented points which are of equal distance forward from the platform rear cross member 42. The distance forward of the indentation will be determined by the size of the rear door threshold of the vehicle in use. If the threshold of the rear door is of minimal size the distance forward of said indentation will be determined by the amount of space necessary to close the upward opening rear door 32 and provide clearance for the handle bar 80 when the frame 74 is fully retracted into the platform 26 as can be seen in FIG. 1.

In FIG. 3, the platform rear bottom cross member 66 connects the rearmost three legs 50 together and runs contiguous along the floor of the van 20, substantially parallel to the upward opening rear door 32 and perpendicular to said legs 50. The platform rear bottom cross member 66 has a lesser diameter than the other components of the platform 26 and is designed to prevent the platform rearmost legs 50 from bending inward when weight is applied to the extended flame 74, therefore helping to maintain the rectangular form of said frame which slides in the guide tubes 56 that run through the platform legs 44, 46, 48 and 50.

The platform forward bottom cross member 68 connects the two platform forward most side legs 44 and extends between said legs contiguous to the floor of the van 20 and perpendicular to the legs 44. The diameter of the platform forward bottom cross member 68 equals the diameter of the platform rear bottom cross member 66.

Figure 5:
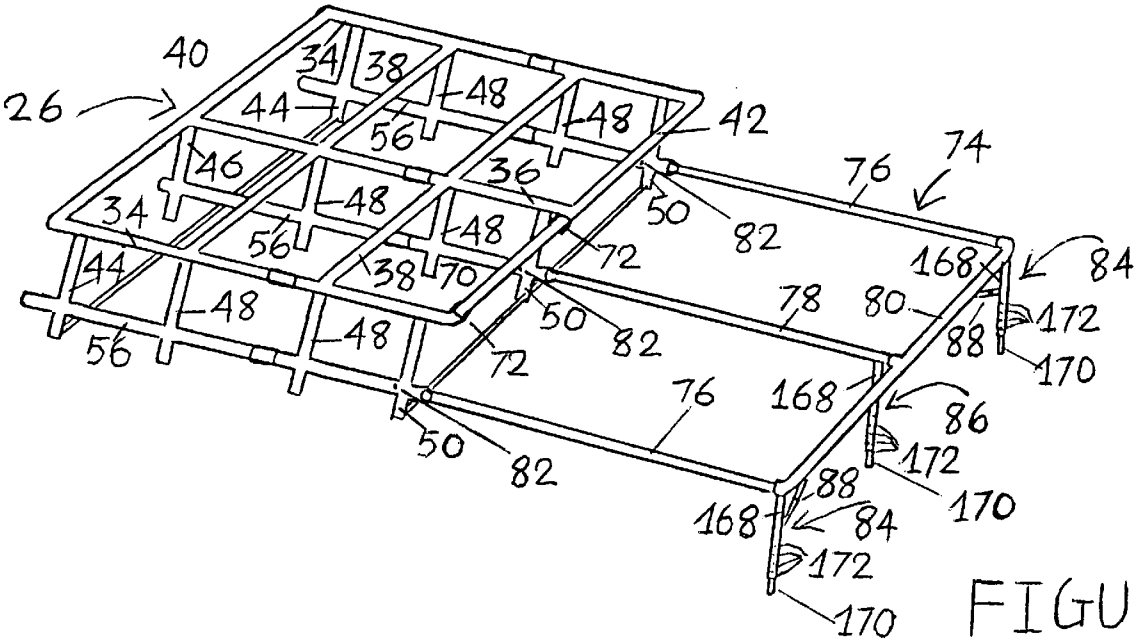
FIG. 5 is a top side view showing the frame extended out of the rearward end of the platform with the adjustable support legs unfolded to the ground.
Figure 6:
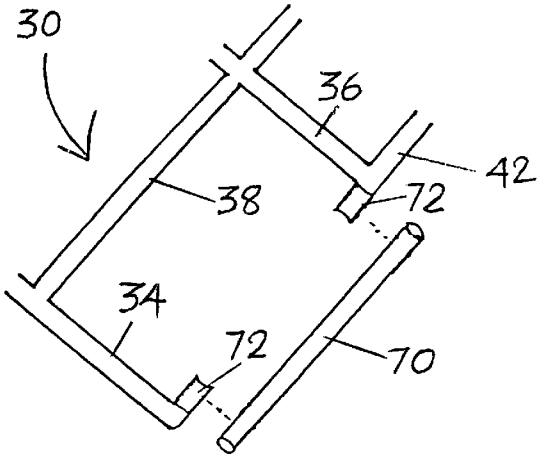

Referring to FIG. 5, the platform rear cross member 42 will have one, removable piece 70 on one side there of that rests on "U'" shaped cradle mounts 72 at both ends. On one side means between the platform center member 36 and one platform side member 34. The "U" shaped cradle mounts 72 will be attached to the rearmost end of the platform center member 36 and one platform side member 34. This feature allows the user to remove a portion of the rear cross member 42 in order to conveniently store and access large items in the platform 26 without restriction as can be seen in FIG. 6. This removable piece 70 of the platform rear cross member 42 will be approximately one half the length of the total length of said rear cross member.

Referring to FIG. 5, inside, running through and between the legs 44, 46, 48, and 50 of the platform 26, are guide tubes 56 that are parallel to each other and the two platform side members 34 and the platform center member 36 accordingly. The distance of the guide tubes 56 up from the bottom of the legs 44,46,48 and 50 will be determined by the amount of clearance needed for the frame 74 to be retracted and extended over the back door threshold of the vehicle in use. The guide tubes 56 are used in conjunction with the frame 74.

The frame 74 is in the extended position with the adjustable support legs 84 and 86 folded down. The frame 74 extends above the ground rearwardly from the platform 26 and is dimensioned such that it will extend substantially under the rearward portion of the tent-like cover. The frame 74 is a horizontal frame which includes two frame side members 76, one frame center member 78 joined to the handle bar 80 all are on a level plain. The frame 74 has no forward cross member and the shape of said frame is similar to that of the letter "E". The width of the frame 74 is substantially equal to the width of the platform 26 and said frame's length is longer than the length of the platform 26. Referring to FIG. 3, the frame 74 extends rearwardly from the rearward end of the platform 26. The forward end of the frame 74, when extended, is supported above the ground by the rear of the van 20. Support is conveyed to the forward end of the frame 74 via the frame side members 76 and the frame center member 78 resting on and inside of the respective guide tubes 56 which in turn run through and are supported by the platform legs 50 which rest on the floor of the van 20.

Referring to FIG. 5, the frame 74 is retracted into and extended on: from the platform 26 by way of a tube within a tube sliding means. The guide tubes 56 encircle the frame side members 76 and frame center member 78 and act as a guide and holder for said members. The frame side members 76 and the frame center member 78 slide laterally inside the guide tubes 56. Once the frame 74 has been extended to the desired length, the flexible projection in each frame side member 76 and frame center member 78 will engage into the apertures 82 in their respective guide tubes 56 in order to hold the frame 74 in a stationary position. The projections are flexible such that they may be pressed inwardly to release the frame side members 76 and frame center member 78 in order to be taken out or slid forward into their respective guide tubes 56.

Referring to FIG. 3, in most cases when traveling the weight of the stored belongings and equipment, in the van 20, will adjust the suspension causing the vehicle to move down so that more added weight will have little effect on the van 20 to sink farther. Therefore no adjustments will need to be made between the frame 74 and the van 20.

At times when your traveling light and the frame 74 is fully extended, adjustments to said frame for downward van 20 movement need to be made when weight is applied to said van. The simplest solution would be to place a brace between the under frame of said van and the ground in order lo prevent the suspension from adjusting for weight changes (not shown).

In an attempt to limit the amount of separate components we have designed the guide tubes 56 in such a way to allow for the frame 74 to adjust to the van 20 suspension movement. In the rearward portion of the guide tubes 56 there is an elongated opening at the bottom surface of said guide tubes just forward of where the flexible projections engage into the apertures 82 in the sides of said guide tubes. Just rear of where the flexible projections engage into the apertures 82, the upper surface of the guide tubes 56 taper upward slightly so that if you were to look at the rear most openings of the guide tubes 56 said openings would be slightly oval shaped or rectangular depending on the shape of the guide tubes 56. The frame side members 76 and the frame center member 78 now have the ability to move similar to that of a seasaw on a fulcrum. The flexible projections of the frame side members 76 and the frame center member 78 engage into the apertures 82 at the fulcrum of the guide tubes 56 allowing the said members of the frame 74 to pivot slightly, like a lever, in order to adjust for the van 20 suspension movement downward because of the weight applied to said van.

The frame can further more be retracted and extended by a rollers on tracks system as an alternative (not shown). Instead of guide tubes, attached to the bottom portion of the legs of the platform, are sectional tracks that will extend parallel to the vehicle floor with each track parallel to each other and to the platform side members and the platform center member accordingly. The guide track sections are connected together by means of a bracket and held in place by flat head bolts and nuts through aligned apertures. The guide tracks will all be of equal distance up from the vehicle floor and down from the platform side members and the platform center member. The height of the tracks from the vehicle floor will be determined by the height of the back door threshold of the vehicle in use. The rollers on tracks system will have a guide guard in order to prevent blockage due to storage shifting or falling into the path of the frame. The guide guard is a substantially long plate, approximately the length of the guide tracks, attached to the platform legs and extends laterally above and to the inside of the rollers on tracks system. The guide guard plate is made of any suitable rigid material that is light in weight, strong and sturdy.

Support is conveyed to the frame via roller wheels located, respectively, adjacent laterally opposite the frame side members and also along the frame center member and slightly rearwardly of the forward end of the frame. The roller wheels rest upon guide tracks attached to the platform legs. Each roller wheel is attached to a respective downwardly facing "U" shaped rail which is in turn attached to respective frame side members and frame center member, rails extending along the length there of. The roller wheels are attached within rails such that the bottom of the roller wheels protrude downwardly out from the open end of the "U". The lower protruding portion of each roller wheel in turn rests upon the upper surface of the respective guide track. Additional roller wheels are spaced along the inside of rails in a similar fashion to facilitate sliding the frame into and out of the platform and rear of the vehicle. (rollers in tracks system is not shown). All such modifications are intended to lie within the scope of this invention.

Figure 10:
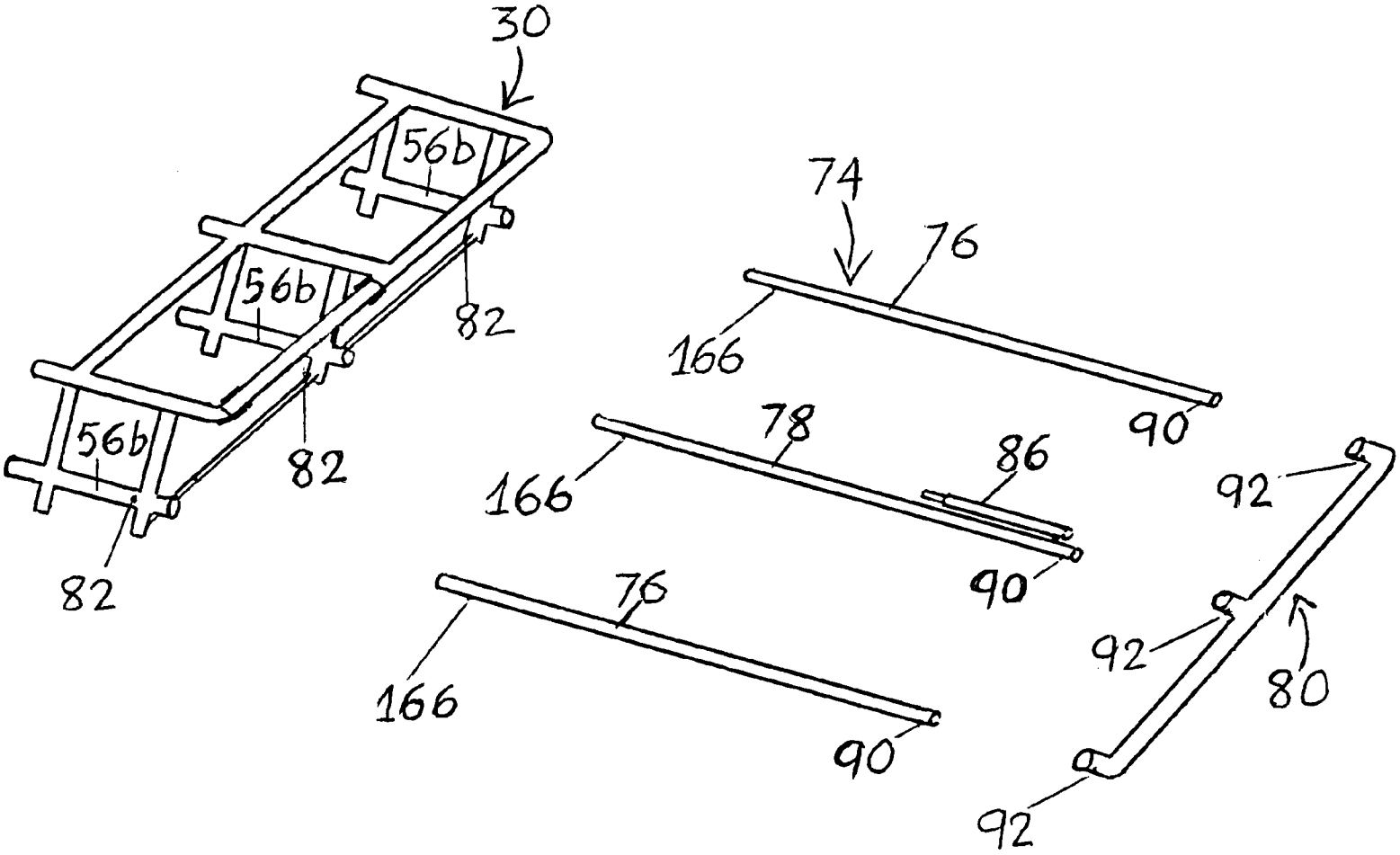
FIG. 10 shows the rear platform section and the components for the frame assembly.
Figure 11:
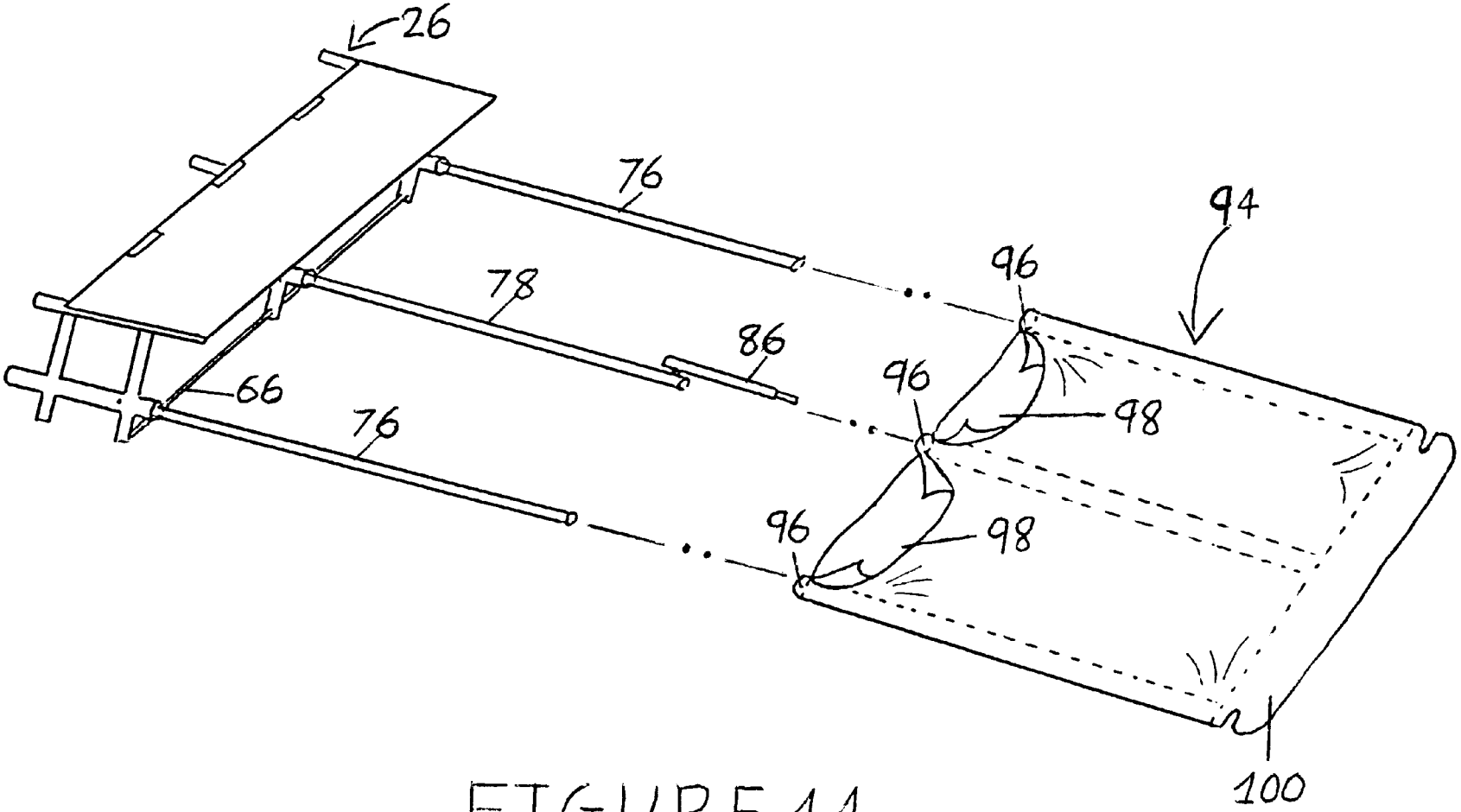
FIG. 11 illustrates the cot and its installation.

Referring to FIG. 5, the rearward end of the frame 74 is supported above the ground by three adjustable support legs 84 and 86. Two support legs 84 are attached by hinge flanges to the bottom surface and at opposite ends of the handle bar 80. The third support leg 86 is hingeably attached to the rearward side of the frame center member 78. Said legs unfold and extend vertically downward resting upon the ground. The frame support legs 84 attached to the handle bar 80 are supported by a pair of foldable scissor struts 88 attached between the support legs 84 and the side of the handle bar 80. The support leg 86 attached to the frame center member 78 is without scissor struts and is attached to said member in such away that when it is folded up there is a gap or space between said member and said leg as can be seen in FIG. 10. This gap provides clearance so that when said member is retracted into the center guide tube 56, said leg will extend adjacent to the exterior of and to the side of the center guide tube 56. The leg 86 must be folded up along the side of the frame center member 78 in order to retract said member. This support leg 86 does not enter the guide tube 56. Referring to FIG. 11, without the handle bar 80 attached, the leg 86 is designed to pivot one hundred and eighty degrees to a position that is parallel to and extends substantially rearward of the frame center member 78. This helps to simplify the cot 94 installation process. Referring to FIG. 5, when the handle bar 80 is attached to the frame center member 78 it acts like a stopper to said leg and maintains it in a perpendicular orientation to said member and the handle bar 80.

The adjustable support legs 84 and 86 are all comprised of a hollow leg tube 168 that telescopically receives an associated leg member 170. A plurality of apertures are disposed in the wall of each leg tube 168 so that the flexible projections in each leg member 170 will engage in the associated aperture 172 once the required distance to reach the ground has been met. The leg member 170 simply slides in or out of the leg tube 168 until the desired distance has been reached. To disengage the leg member 170 press inwardly on the flexible projections to release and adjust the length of said leg member.

Figures 7, 8:
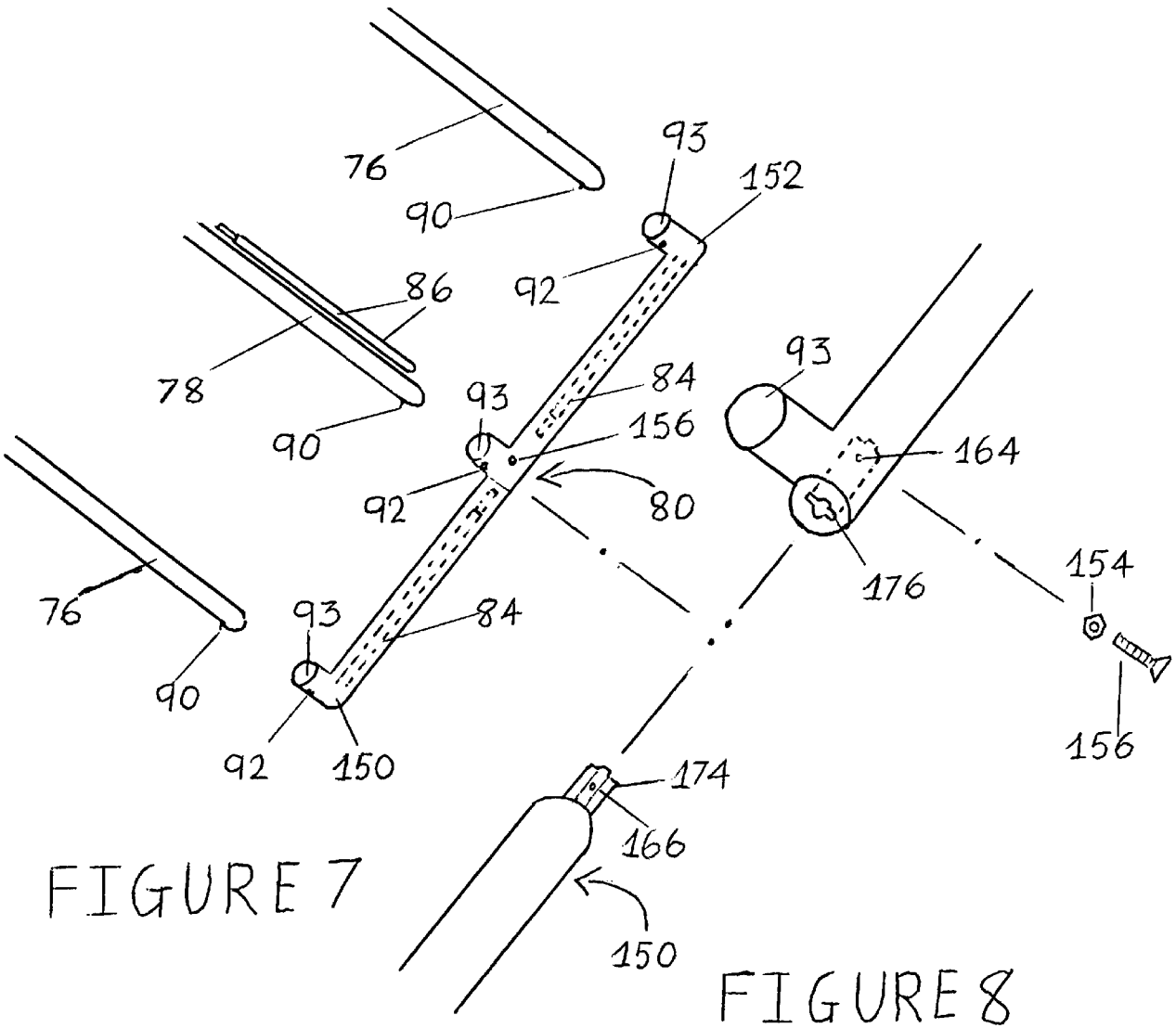
FIG. 7 shows the handle bar in the detached position with all the frame adjustable support legs underneath in the folded position.
FIG. 8 is an exploded view of how the handle bar is assembled.

Retracting and extending the frame 74 will usually be accomplished by either pushing or pulling on the handle bar 80 as can be seen in FIG. 5. In FIG. 7, the handle bar 80 is disconnected rearwardly from the rearward ends of the frame side members 76 and the frame center member 78. To connect, slide the frame center member 76 and the frame side members 78 into their respective handle bar flanges 93 until the flexible projections 90, of said members, engage into the apertures 92 in the handle bar flanges 93. The frame members 76 and 78 are held in place by means of these flexible projections 90 engaging into the apertures 92 along each flange 93 of the handle bar 80. To disengage any of the said members simply press inwardly on the flexible projections 90 to release and pull out said member or members. The adjustable support legs 84 are hingeably attached at the opposite ends to the bottom surface of the handle bar 80. The length of the handle bar 80 is substantially equal to the width of the platform. The handle bar 80 can be constructed of any suitable rigid material that is light in weight, strong and sturdy.

Figure 9:
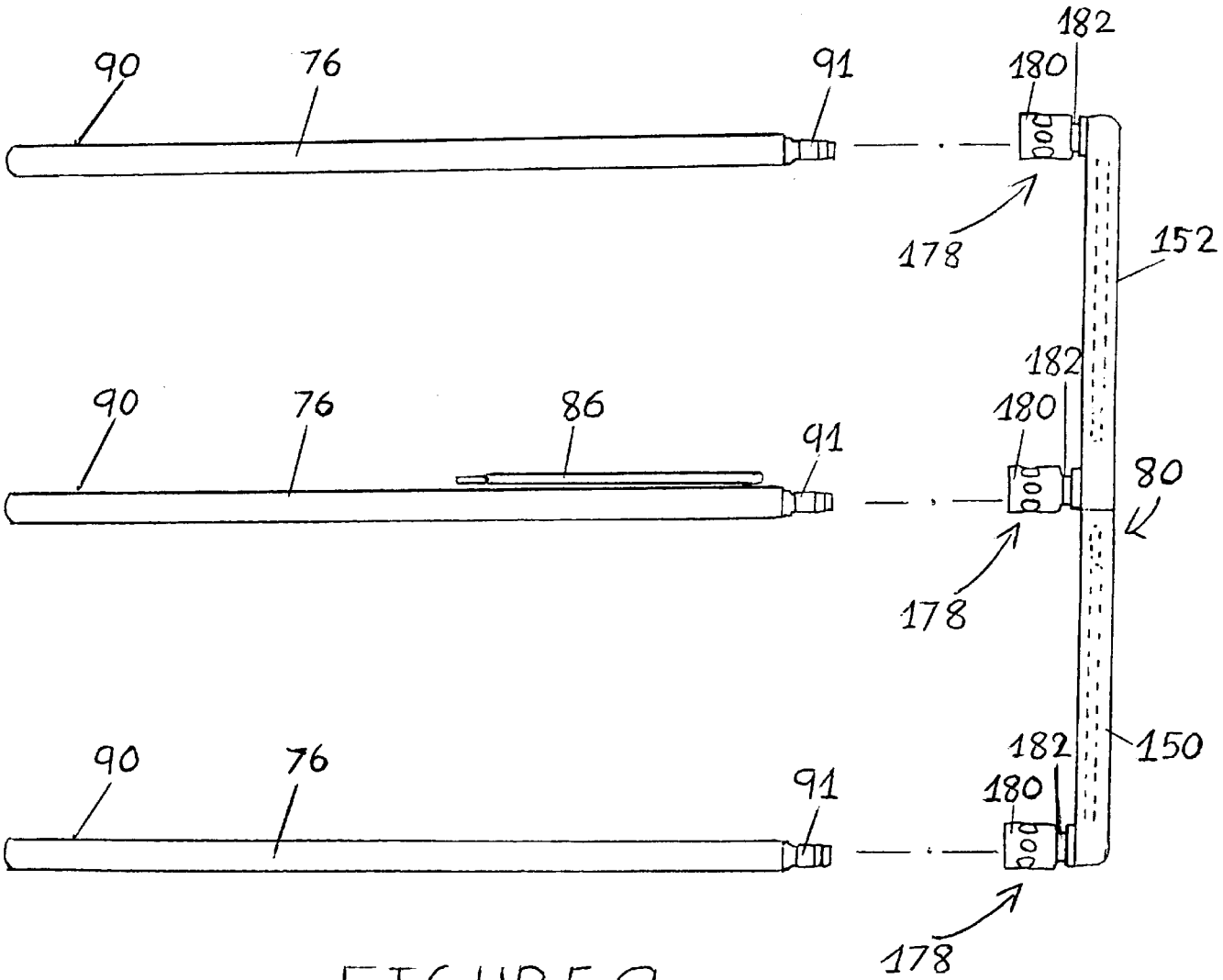
FIG. 9 is the coupling to adapter process of connecting the frame members to the handle bar.

Referring to FIG. 9, another method of connecting the frame center member 78 and the frame side members 76 to the handle bar 80 is by inserting adapters 91, attached to the rearward end of each said member, into their respective handle bar couplings 178. The couplings 178 are located on the handle bar 80 in place of the flanges 93. The adapters must be inserted inside the couplings 178 as far as they will go until you hear a click. The click indicates that the coupling 178 has locked around the adapter 91. To disconnect, grip and slide back the release sleeve 180 on the coupling shank 182, hold the components firmly and pull apart. This method works similar to the connecting devices often used on your typical garden hoses for fast and simple connections to faucets, spray nozzles and between hoses.

Located along the bottom surface of each adapter 91 is a flute that fits over a screed located along the inside bottom wall of the coupling shank 182. The flute running along the screed prevents the center member 78 and the side members 76 from turning and thus assuring that the frame member flexible projections 90 always align with their respective guide tube apertures 82.

Referring to FIG. 8, the handle bar 80 can be separated into a male piece 150 and a female piece 152. The male piece 150 has a dowel 174 at one end that slides into the orifice 176 of the female piece 152. Once said pieces have been completely fitted together the aperture 164 in the female piece 152 will line up with the aperture 166 in the male piece 150 in order for a flat head bolt 156 to be inserted through said apertures and said bolt 156 is tightened in place with a nut 154. The aperture 164 along the female piece 152 has a larger opening that enables the bolt 156 and the nut 154 to be recessed into said female piece. Referring to FIGS. 7, 8 and 9, the female piece 152 has two flanges 93 or two couplings 178 to accomodate one frame side member 76 and the frame center member 78. The male piece 150 has one flange 93 or one coupling 178 to accomodate one side member 76 at one end and the insertable dowel 174 at the other end. One support leg 84 is hingeably attached to the bottom surface of the male piece 150 and one support leg 84 is hingeably attached to the bottom surface of the female piece 152. The male piece 150 and the female piece 152 are joined together to form the handle bar 80.

Referring to FIG. 10, the user can disengage any of the frame members 76 and 78 from the handle bar 80 to create different configurations for use. The frame center member 78 can be disengaged from the handle bar 80 and retracted into the platform to create a substantially large room. Either of the frame side members 76 can be disengaged from the handle bar 80 and retracted for unimpeded side entry into the enclosure. The handle bar 80 can be separated and with the extended frame center member 78 and frame side member 76 attached to the handle bar female piece 152 it creates a substantially long table. Although the option is available we don't suggest separating the handle bar 80 unless you need to create a specific configuration because the components can be lost. Of course the most commonly used configuration will be with all the frame members 76 and 78 attached to the handle bar 80 and the frame 74 fully extended out of the platform 26 in order to sleep on the cot 94 or the fan-fold panel 102 as can be seen in FIG. 4 and FIG. 12.

Referring to FIG. 10, the frame 74 can be completely disassembled and the components can be stored under the seats to be used in setting up said frame later. This set up involves assembling the frame 74 and then plugging the frame center member 78 and the frame side members 76 into the rearward openings of the associated guide tube portions 56*b* until the flexible projections 166 on each said member engages into the apertures 82 in the guide tube portions 56*b*. This use does not require a sliding means because you simply assemble the frame 74 and plug it into the guide tube portions 56*b* of the rear platform section 30. It is the simplest means of erecting the frame 74 extension and can be used in conjunction with either the platform 26 or the rear platform section 30. When the frame 74 is used with the rear platform section 30 only, the user can maintain all of the seats in the vehicle.

Refferring to FIG. 11, once the frame has been fully extended to the rear of the platform 26 the user has two options to consider for the sleeping arrangements. One would involve using a slip on cot 94. The cot material can be of any type of strong fabric sown at both sides and the center creating elongated tunnel-like openings 96. The tunnel-like openings 96 of the cot 94 are designed to slip on and fit around the frame center member 78 and the frame side members 76. To install the cot 94, the handle bar is released to expose the ends of the adjustable support leg 86, the frame center member 78 and the frame side members 76 in order to allow the user to slide the cot 94 onto and over the frame side members 76 and the frame center member 78. Before slipping the cot 94 onto the frame center member 78, unfold the adjustable support leg 86 by pulling it down and toward the rear approximately one hundred and eighty degrees. The leg 86 will look like an extension to the frame center member 78 when in the aforementioned position and will make the installation easier. Referring to FIGS. 4 and 11, on top of the forward most portion of the cot 94, front flaps 98 are sewn in and extended into the rear portion of the van 20 and tucked underneath the platform rear bottom cross member 66 to provide an insect proof barrier. On the top of the rear most portion of the cot 94, a sufficient size rear flap 100 is sewn into the cot material in order to wrap around the handle bar 80 and extended to the bottom side of the cot 94 and secured therein by means of snaps and/or "VELCRO" to provide attachment for rear support to the cot 94 and an insect proof barrier. The cot 94 option is lighter in weight, requires less storage space and allows the user to sleep comfortably without the need for a mattress.

Figure 13:
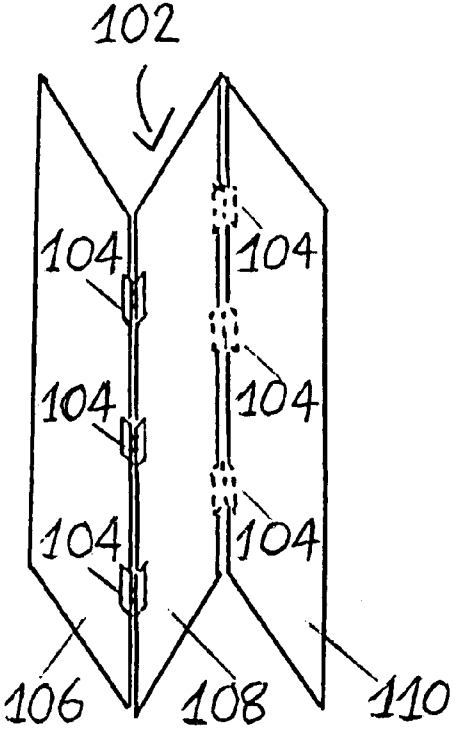
FIG. 13 illustrates how the fan-fold panel folds.
Figure 12:
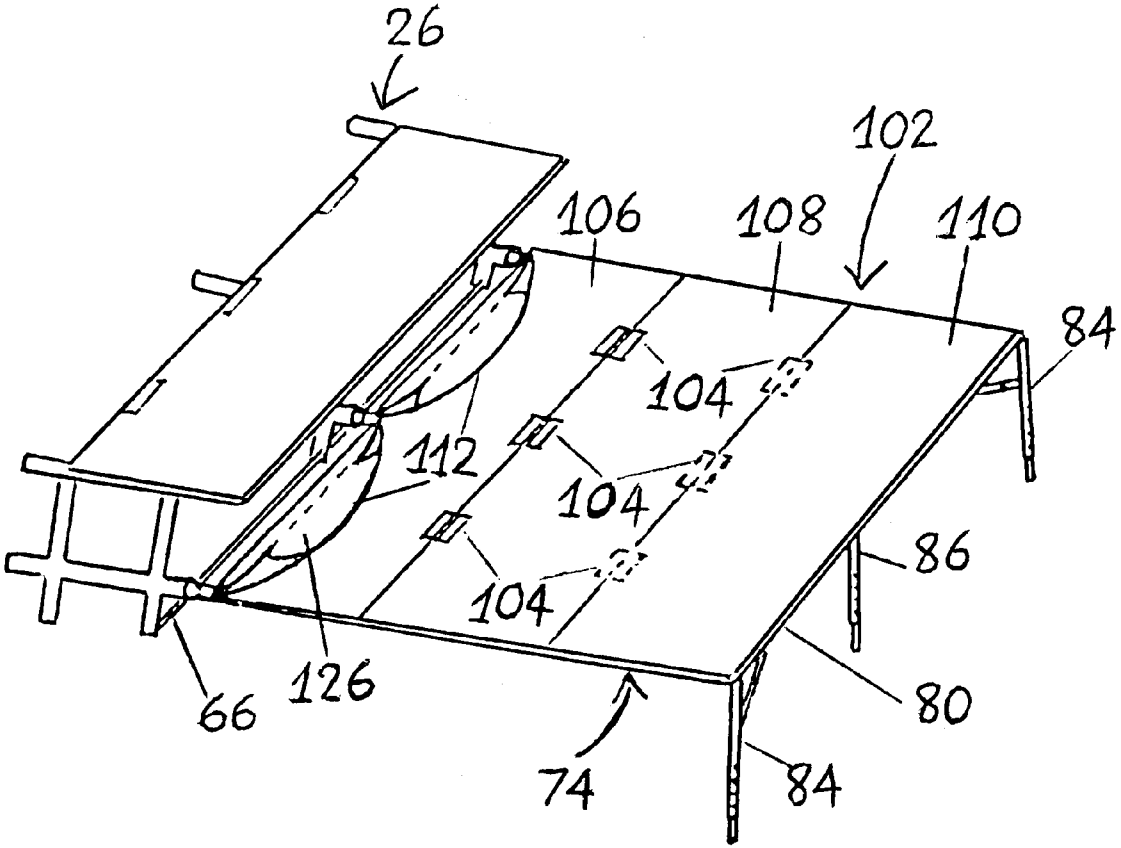
FIG. 12 is a top view of the fan-fold panel in place on top of the frame.

Referring to FIG. 12, the other optional sleeping arrangement involves laying a fan-fold panel 102, made of any suitable rigid, strong, lightweight material, on top of the frame 74 and then use a mattress or blow up mattress for cushioning. This option does not require the users to disconnect and reconnect the handle bar 80 and will offer more sleeping space. Referring to FIG. 13, our invention uses a fan-fold panel 102 consisting of three equal pieces connected by hinges 104 so it may be fan folded to be approximately one third its size for easy storage. The three equal pieces is interpreted as a forward piece 106, a center piece 108 and a rear piece 110. Folded means a plurality of rectangular panel pieces 106, 108 and 110 connected one to another by hinges 104 so that the fan-fold panel 102 will fold similar to that of a hand held fan. The forward piece 106 is hingeably attached to the top forward edge of the center piece 108 and the rear piece 110 is hingeably attached to the bottom rear edge of the center piece 108. The fan-fold panel 102 can be stored on top of or under the platform 26 when not in use. Referring to FIG. 12, flaps 112 of material can be slipped on the forward piece 106 of the fan-fold panel 102 by means of an elastic ring 126 sewn in at the bottom side of the flaps 112 and said flaps are extended forward into the rear of the van 20 and under the platform rear bottom cross member 66 to provide an insect proof barrier.

Figure 14:
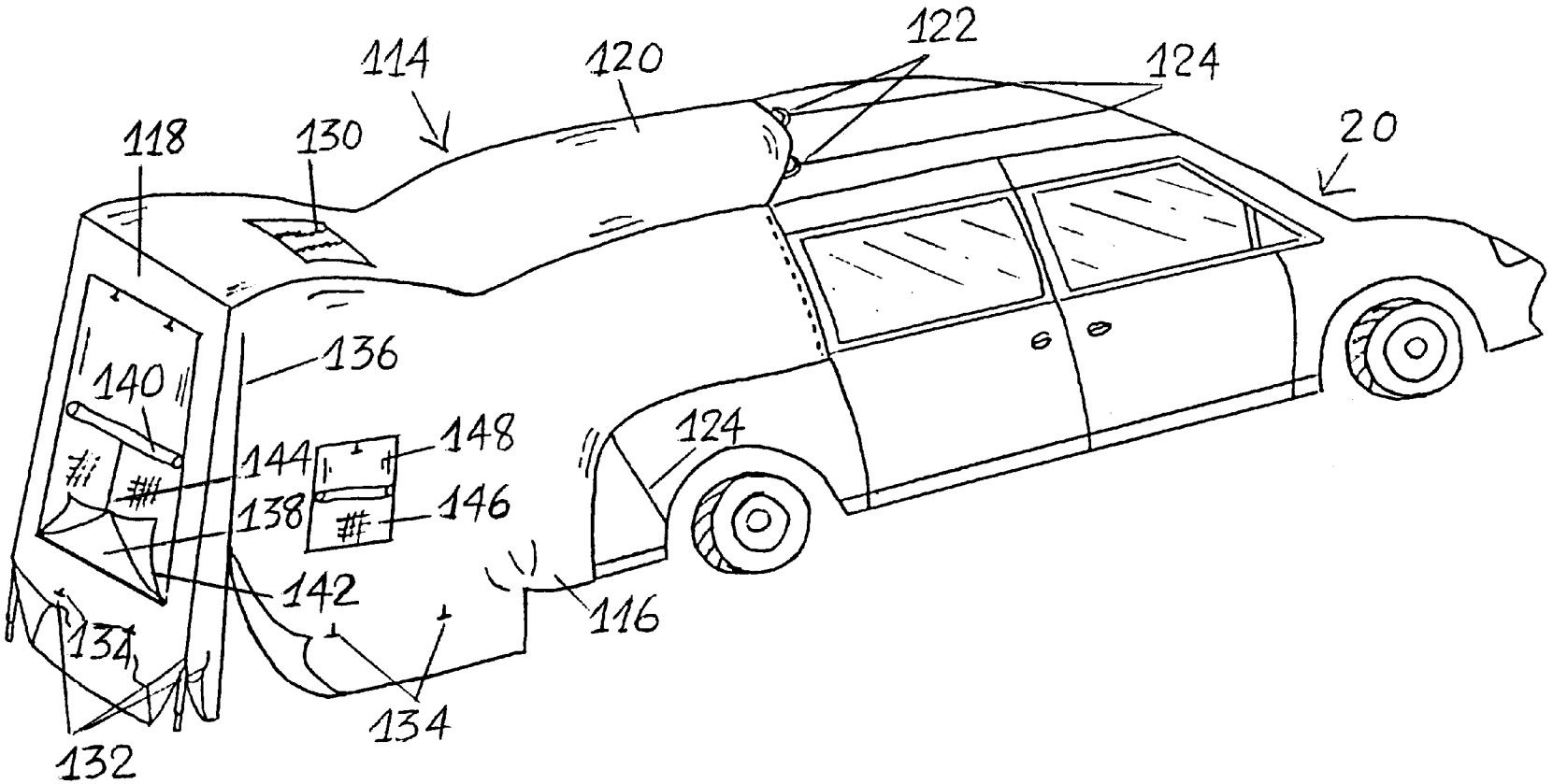
FIG. 14 is a rear-side elevational view of the completed van-tent camping system with one frame side member partially retracted into the platform in order to allow unimpeded entry through the side zipper opening..

FIG. 14 shows the side and the rear view of the completed tent-like structure. It will be noted that the top of the tent-like cover 114 is held in place by and above the upward opening rear door 32 and the body of the van 20, and that each of the side portions 116 and end portion 118 extend from the top portion 120 of the tent-like cover 114 to the ground but not touching the ground, and the side portions 116 are substantially parallel to each other.

The forward most top portion 120 of the tent-like cover 114 extend forward beyond the hip of the roof of the van 20 and lays flat against the contours of the roof. Rain water is substantially directed toward the front of the van 20 because the tent-like cover 114 extends beyond the hip of the roof and on to the forward downward sloping expanse of the roof During heavy rains and wind, excess rain water may build up and seep under the forward top portion 120 of the tent-like cover 114. This water is simply channeled down to the rear sloping section of the roof into the well area of the rear door frame and falls to the ground not effecting the interior of the enclosure structure. This is possible because the tent-like cover 114 is not attached to the lower rear or bumper area of the van 20, it is attached to the frame side members, in the aforementioned area, allowing the rain water to flow past the enclosure structure and fall to the ground.

On the top portion 120 of the tent-like cover 114 forward most hem, two eyelets 122 are sewn into said hem in order to provide support for vans without raised window panes, and/or for extra support in extreme wheather conditions. The eyelets 122 will also be useful in keeping the forward top portion 120, of the tent-like cover 114, snug against the top surface of the van 20 especially when covering a roof mounted storage or ski rack. In both cases, simply thread elastic cords 124 into the eyelets 122, extend and connect said elastic cords to the winshield wiper shafts to keep the forward top portion 120 of the tent-like cover 114 in place. It is the intent of the present invention to not have to use a roof mounted storage rack. The present invention is designed to provide enough storage space so that a roof mounted storage rack will not be needed. Should a roof mounted storage rack be mounted too far forward and/or the roof has little or no slope, a version of the present invention is designed with a longer top portion 120 to extend over and forward of the roof rack. All such modifications are intended to lie within the scope of this invention.

Figure 15:
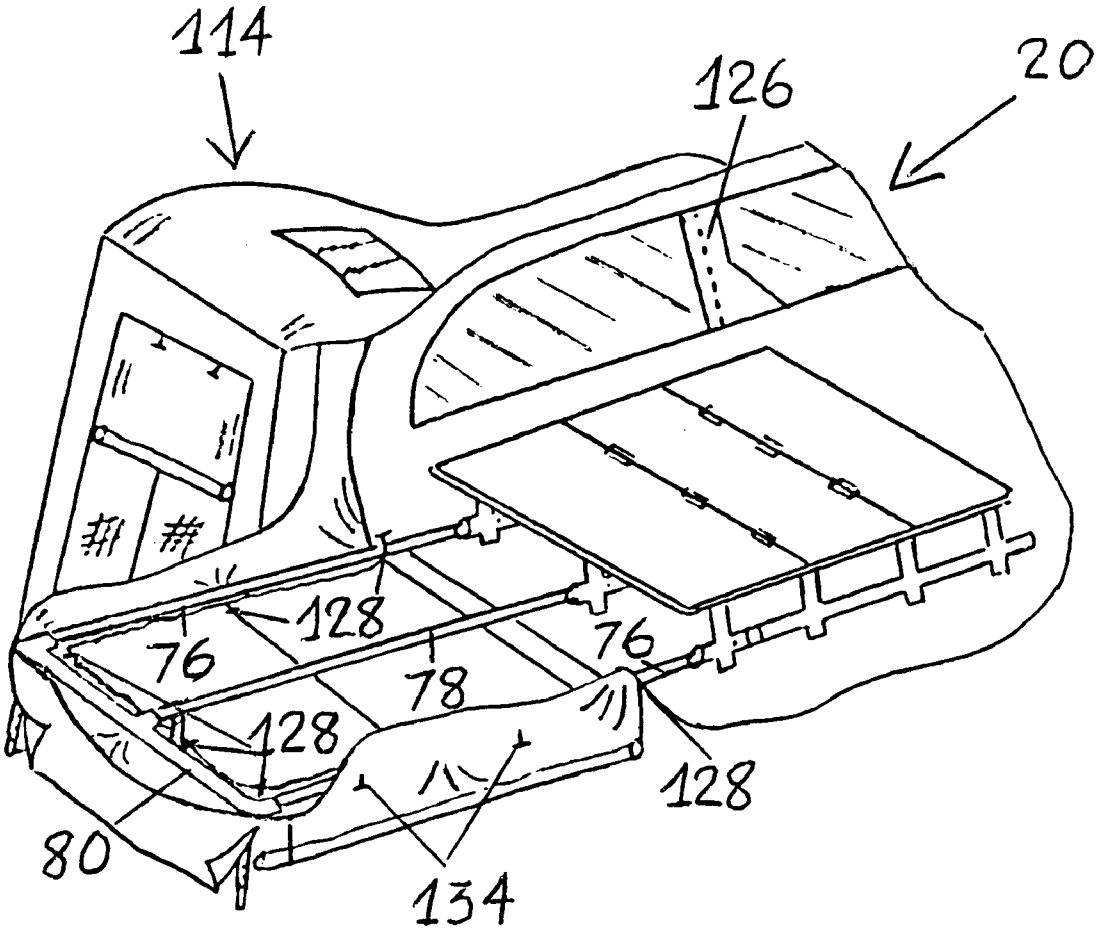
FIG. 15 is a cross sectional view of the van-tent camping system showing how and where the tent-like cover attaches to the frame and the van windows.

Referring to FIG. 15, for vans with raised window panes, the forward most side portions 116 of the tent-like cover 114 has elastic rings 126 sewn at both ends into each of the forward most hem corners and said rings are extended around the forward edge of the rear most side raised window panes to secure the tent-like cover 114 to the van 20. Referring to FIG. 14, for vans without raised window panes, elastic cords 124 are sewn into the tent-like cover side portions 116 and are attached to the under body of the van 20 on one side (not shown) and on the side with the sliding door, the elastic cord 124 is attached to the wheel well in order to provide clearance for the sliding door. In situations where there are sliding doors on both sides and the vehicle has no raised window panes the tent-like cover 114 will be strapped to the wheel wells on both sides and the user would have to extend elastic cords 124 from the eyelets 122 to the winshield wiper shafts to secure the front of said tent-like cover 114. In FIG. 15 the tent-like cover 114 is attached to the frame side members 76 and the handle bar 80 by a plurality of elastic straps 128 sewn into the tent-like cover 114 around the periphery of the frame 74. This secures the tent-like cover 114 to the frame 74 and with the cot or the far-fold panel in place creates an enclosure with an insect proof seal.

Referring to FIG. 14, the tent-like cover 114 extends over the van 20 like a sleeve and covers the rear side windows in order to provide privacy to those sleeping on the platform in the interior of the van 20. The tent-like cover 114 is constructed of any suitable tenting material and is dimensioned to cover a significant portion of the van 20 and the perimeter of the extended frame. Disposed in the top portion of the tent-like cover 114 which rests on and covers the window of the upward opening rear door, is a transparent skylight 130. The skylight 130 is made of a transparent vinyl type material and is substantially dimensioned to the size of the upward opening rear door window it will cover. It is stitched to the tent-like material around the perimeter of the skylight 130.

The lower part of the tent-like cover side portions 116 and end portion 118 are not sewn together from the rearward comers of the frame vertically to the ground. There are sewn in ties 132 at each comer closest to the ground but not touching the ground. This design allows the user to roll up the bottom parts of the tent-like cover 114 on rainy, muddy days, as can be seen in FIG. 15, or have them down and tied at the comers, to hold them in place, for privacy or to conceal belongings. Should the user decide to roll theme up, there are elastic ties 134 sewn into the tent-like cover 114 which are spaced along the frame side members 76 and the handle bar 80. It is effective to have the bottom parts down when using the tent-like enclosure for a changing room as can be seen in FIG. 14.

When using the tent-like enclosure as a dressing room or other uses without the fan-fold panel or the cot in place, there is a zipper 136 disposed in the rearward end of one of the side portions 116 of the tent-like cover 114. The zipper 136 is dimensioned to extend from the top vertically to the bottom of the side portion 116 that it is located on. The zipper 136 when pulled up will separate said side portion creating an opening that allows the user to walk in and walk out of the tent-like enclosure. This is accomplished by disengaging the associated frame side member from the handle bar and retracting it into or partially into the platform in order to create a large enough gap for a person or persons to walk through the open zipper 136 without having to step over said member.

Most vans typically have one side door that usually is a sliding door through which the van 20 may be entered, leading onto the platform and rearward into the tent-like enclosure. However, the tent-like cover 114 has a rear opening 138 at the end portion 118 there of, through which the users of the structure may conveniently enter. The rear opening 138 has a turn back flap 140 and a nylon (or other material) mesh 142 and closing the entry way by means of a zipper 144. The users of the platform may prefer to use the door of the van 20 for entry or exit while the users of the tent-like enclosure may prefer to enter through or from the rear opening 138. The rear opening 138 is designed to be used by persons occupying the cot in the tent-like enclosure.

Besides the rear opening 138 in the end portion 118 of the tent-like cover 114, the side portions 116 also typically have openings 146 and therein, for ventilation purposes. These openings 146 typically are covered with an open mesh material and the outside thereof have flaps 148 which may be used to cover the openings 146 for privacy or weather protection purposes. One side of each of the flaps 148 is sewn to the outer walls of each of the side portions 116 of the tent-like cover 114, and the other sides of the flaps 148 attached there to such as by means of zippers or by means of VELCRO lining at the edges.

The tent-like cover can be used as a privacy cover for those users who choose to sleep in the vehicle and decide not to extend or use the frame (not shown). In this situation the upward opening rear door would remain closed and the user would simply shift the tent-like cover forward on the vehicle, until the end portion of said cover abuts up to the rear of the vehicle. More window glass will be covered with this use providing more privacy inside the vehicle. When using the tent-like cover as a privacy cover, you will need to secure the front of the tent-like cover to the middle window panes and/or extend elastic cords from the eyelets to the winshield wiper shafts. The tent-like cover would also have to be attached to the vehicle rear bumper, the wheel wells and/or the under frame, of the side of the vehicle, by using elastic straps from the tent-like cover. When using the tent-like cover as a privacy cover the vehicle's two front doors would need to be used for entry and exit.

Figure 16:
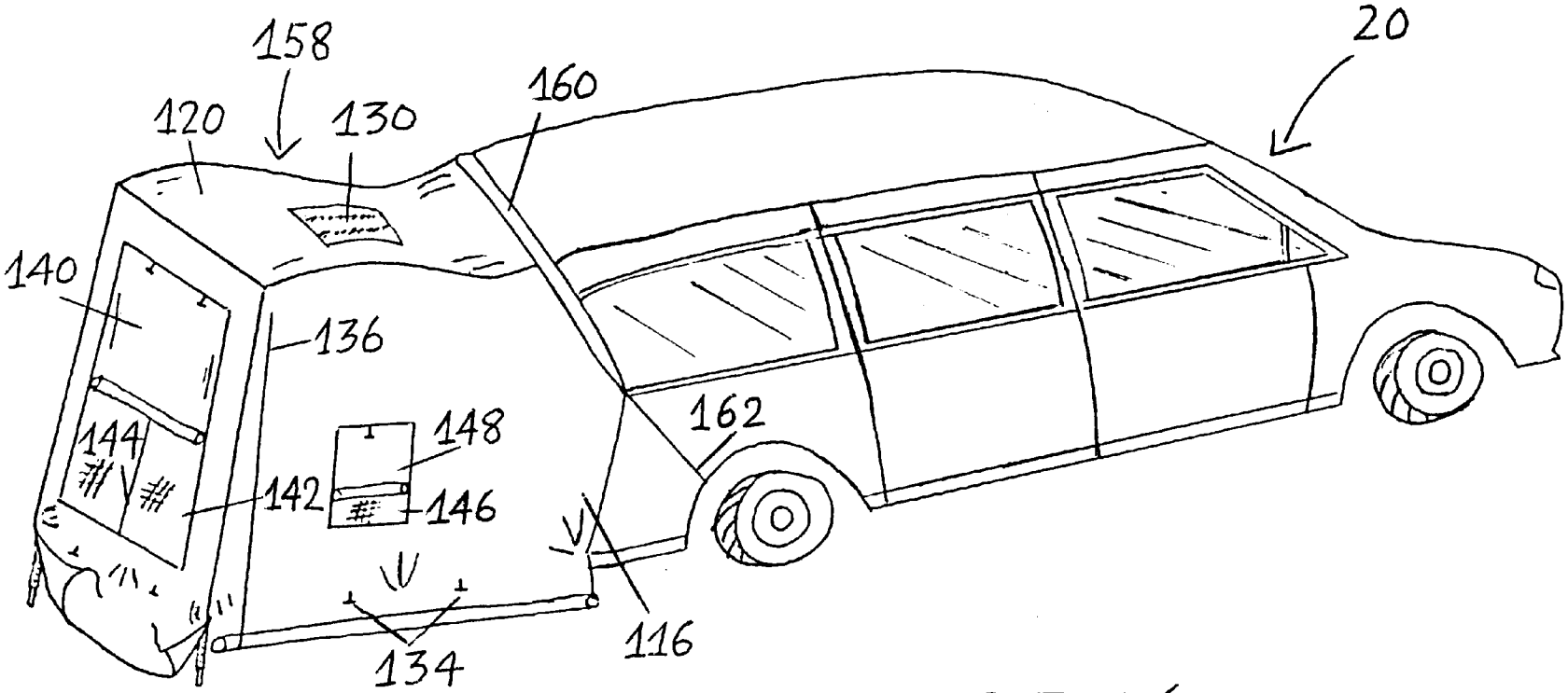
FIG. 16 is a rear-side elevational view of the completed van-tent cam ping system using the short tent-like cover.

Referring to FIG. 16, there are situations when families need to travel with large objects secured to the roof of the vehicle such as cargo carriers, a boat or a larger than normal rack. These large objects are an obstruction so we designed a short version of the tent-like cover 158 that has less distance forward on the roof and sides of the van 20, a different means of attachment to the van body and covers less window space. The dimensions are coordinated so that the leading edge of the short tent-like cover 158 can be pulled over the upward opening rear door in its fully raised position and to fit snugly over the top of the van 20 at its rear end. A flexible rubber-like strip 160 is sewn into the forward most hem of the top portion 120 end side portions 116 of the short tent-like cover 158 in order to provide a means to form a water tight seal and securely attach said tent-like cover to the van 20.

The flexible rubber-like strip 160 is stretched across the rearward end of the roof and partially down the sides of the van 20 by extending the cords 162, attached to both ends of said rubber-like strip, and securing said cords to the rear wheel wells by means of a hook or similar attaching advice.

The flexible rubber-like strip 160 is substantially long enough to extend over the width of the rearward top of the van 201 and partially down the sides of said van. The flexible rubber-like strip 160 is wide enough to allow for a tent-like fabric to be sewn in on one side and on the other side provide a sufficient amount of rubber-like surface area to come in contact with the van body for a water tight seal and a secure attachment to the van 20. The stretching of the flexible rubber-like strip 160 against the surface of the van 20 will create a water tight seal. In some cases when the roof of the van 20 is not totally flat and/or the weather is extreme, excess rain water may leak through the seal and under the short tent-like cover 158. This water is simply channeled down off the rear of the roof into the well area of the rear door frame and falls to the ground not effecting the interior of the enclosure structure.

For sport utility vehicles with only front seating and one row or one set of rear seating the platform is only one piece. All such modifications are intended to lie within the scope of this invention.

SUMMARY

A difficulty with most vans and sport utility vehicles is that the interior space is limited. Thus when used for recreational purposes the accomodations inside the vehicle must be arranged so that equipment and belongings carried during travel can be compactly stowed to leave room for sleeping accomodations. In a mini-van particularly, such storage space and sleeping space is usually inadequate. After a day's travel the travelers must transfer their belongings to free the beds and the like in order to have less than adequate sleeping arrangements. Clearly this is a burdensome and a time consuming task, particularly since it must be done at the end of a long day's travel. The aforementioned inconveniences along with the tedious set up and take down time associated with tent camping will often force a family to choose a more expensive hotel over less expensive, well located camping for nightly stops.

It is the intent of our invention to make less expensive short term camping a cost effective viable alternative over other more expensive accomodations without compromising convenience and comfort. The present invention increases the sleeping space and at the same time provides plenty of room for storing belongings in an aesthetically pleasing way and will not require rearrangement in order to sleep.

The present invention is designed to be compact, sturdy, lightweight, adaptable to various sizes of vehicles with upward opening rear doors, easy to erect, virtually insect and weatherproof, and a system that does not interfere with the normal use of the vehicle.

Having thus described our invention, we claim:

1. A camping system for use with a vehicle having a rear cargo area comprised of:

a. a platform having a plurality of horizontal guide tubes intersecting in a perpendicular manner through a plurality of vertical support members and a frame for supporting a cot housed in said guide tubes;

b. said platform having opposed longitudinally extending horizontal side members and a longitudinally extending horizontal center member evenly spaced between said longitudinally extending horizontal side members and opposed laterally extending front and rear horizontal members and two laterally extending horizontal center members spaced between said laterally extending front and rear horizontal members and three longitudinally arranged rows with a plurality of vertical support members consisting of opposing side rows adjacent to said vehicle side walls and a center row evenly spaced between said side rows for supporting said platform in a fixed position with a rigid planar material positioned in a horizontal orientation on top of said longitudinally extending horizontal members and said laterally extending horizontal members of said platform;

c. horizontally extending through and supported by each said row of vertical support members is its respective said guide tube that intersects each said vertical support member in a perpendicular manner such that a substantial open area is provided for beneath said platform;

d. said open area is covered by said rigid planar material having a forward portion lid and a rear portion lid hingeably attached to a center portion for access to cargo in said open area;

e. said frame is constructed of three frame members that are housed inside its respective said guide tubes such that one end of each said frame member protrudes from the rear of said guide tubes;

f. a coupling means to facilitate connecting a handle bar to the protruding end of said frame members allowing said frame members to slideably enter or exit said guide tubes in a telescoping manner;

g. a handle bar constructed of two sectional portions each having a coupling means to facilitate connecting said sectional portions;

h. a cot being made of fabric supported by said frame;

i. said cot having evenly spaced straps sewn in around its perimeter to facilitate installing a tent like cover.

2. A camping system for use with a vehicle having a rear cargo area comprised of:

a. a platform having a plurality of horizontal guide tubes intersecting in a perpendicular manner through a plurality of vertical support members and a frame for supporting a cot housed in said guide tubes;

b. said platform having opposed longitudinally extending horizontal side members and a longitudinally extending horizontal center member evenly spaced between said longitudinally extending horizontal side members and opposed laterally extending front and rear horizontal members and two laterally extending horizontal center members spaced between said laterally extending front and rear horizontal members and three longitudinally arranged rows with a plurality of vertical support members consisting of opposing side rows adjacent to said vehicle side walls and a center row evenly spaced between said side rows for supporting said platform in a fixed position with a rigid planar material positioned in a horizontal orientation on top of said longitudinally extending horizontal members and said laterally extending horizontal members of said platform;

c. horizontally extending through and supported by each said row of vertical support members is its respective said guide tube that intersects each said vertical support member in a perpendicular manner such that a substantial open area is provided for beneath said platform;

d. said open area is covered by said rigid planar material having a forward portion lid and a rear portion lid hingeably attached to a center portion for access to cargo in said open area;

e. said platform constructed of two sectional portions each having a coupling means to facilitate connecting said sectional portions;

f. said frame is constructed of three frame members that are housed inside its respective said guide tubes such that one end of each said frame member protrudes from the rear of said guide tubes;

g. a coupling means to facilitate connecting a handle bar to the protruding end of said frame members allowing said frame members to slideably enter or exit said guide tubes in a telescoping manner;

h. a handle bar constructed of two sectional portions each having a coupling means to facilitate connecting said sectional portions;

i. a cot being made of fabric supported by said frame;

j. said cot having evenly spaced straps sewn in around its perimeter to facilitate installing a tent like cover.

3. A camping system for use with a vehicle having a rear cargo area comprised of:

a. a platform having a plurality of horizontal guide tubes intersecting in a perpendicular manner through a plurality of vertical support members and a frame for supporting a cot housed in said guide tubes;

b. said platform having opposed longitudinally extending horizontal side members and a longitudinally extending horizontal center member evenly spaced between said longitudinally extending horizontal side members and opposed laterally extending front and rear horizontal members and two laterally extending horizontal center members spaced between said laterally extending front and rear horizontal members and three longitudinally arranged rows with a plurality of vertical support members consisting of opposing side rows adjacent to said vehicle side walls and a center row evenly spaced between said side rows for supporting said platform in a fixed position with a rigid planar material positioned in a horizontal orientation on top of said longitudinally extending horizontal members and said laterally extending horizontal members of said platform;

c. horizontally extending through and supported by each said row of vertical support members is its respective said guide tube that intersects each said vertical support member in a perpendicular manner such that a substantial open area is provided for beneath said platform;

d. said open area is covered by said rigid planar material having a forward portion lid and a rear portion lid hingeably attached to a center portion for access to cargo in said open area;

e. said platform constructed of two sectional portions each having a coupling means to facilitate connecting said sectional portions;

f. said frame is constructed of three frame members that are housed inside its respective said guide tubes such that one end of each said frame member protrudes from the rear of said guide tubes;

g. a coupling means to facilitate connecting a handle bar to the protruding end of said frame members allowing said frame members to slideably enter or exit said guide tubes in a telescoping manner;

h. a handle bar constructed of two sectional portions each having a coupling means to facilitate connecting said sectional portions;

i. a cot being made of fabric supported by said frame.

* * * * *